US008667626B2

(12) United States Patent
Zheng

(10) Patent No.: US 8,667,626 B2
(45) Date of Patent: Mar. 11, 2014

(54) COLLAPSIBLE BABY PLAY STATION

(75) Inventor: Yu Zheng, Walnut, CA (US)

(73) Assignee: Patent Category Corp, Walnut, CA (US)

( * ) Notice: Subject to any disclaimer, the term of this patent is extended or adjusted under 35 U.S.C. 154(b) by 100 days.

(21) Appl. No.: 12/924,818

(22) Filed: Oct. 5, 2010

(65) Prior Publication Data

US 2012/0083183 A1 Apr. 5, 2012

(51) Int. Cl.
*A47D 13/06* (2006.01)

(52) U.S. Cl.
USPC ..... 5/99.1; 5/655; 5/414; 446/227

(58) Field of Classification Search
USPC ..... 5/99.1, 98.1, 97, 93.1–102, 425, 414, 5/416, 417, 418, 655; 256/73, 24; 135/91–143; 446/227
See application file for complete search history.

(56) References Cited

U.S. PATENT DOCUMENTS

| | | | |
|---|---|---|---|
| 1,217,932 | A | 3/1917 | Fitzgerald |
| 1,691,904 | A | 11/1928 | Gamble |
| 1,990,804 | A | 2/1935 | Watson |
| 3,014,516 | A | 12/1961 | Muller |
| 3,288,157 | A | 11/1966 | Szkolny |
| 3,675,667 | A | 7/1972 | Miller |
| 3,709,237 | A | 1/1973 | Smith |
| 3,929,145 | A | 12/1975 | Schroeder |
| 3,960,161 | A | 6/1976 | Norman |
| 3,990,463 | A | 11/1976 | Norman |
| 4,073,105 | A | 2/1978 | Daugherty |
| 4,716,918 | A | 1/1988 | Hayashida et al. |
| 4,815,784 | A | 3/1989 | Zheng |
| 4,825,892 | A | 5/1989 | Norman |
| 4,858,634 | A | 8/1989 | McLeese |
| 4,938,243 | A | 7/1990 | Foster |
| 5,024,262 | A | 6/1991 | Huang |
| 5,031,652 | A | 7/1991 | Lester |
| 5,035,460 | A | 7/1991 | Huang |
| 5,038,812 | A | 8/1991 | Norman |
| 5,116,273 | A | 5/1992 | Chan |
| 5,137,044 | A | 8/1992 | Brady |
| 5,163,461 | A | 11/1992 | Ivanovich et al. |
| 5,213,147 | A | 5/1993 | Zheng |
| 5,249,592 | A | 10/1993 | Springer et al. |
| 5,337,772 | A | 8/1994 | Habchi |
| 5,343,887 | A | 9/1994 | Danaher |
| 5,358,440 | A | 10/1994 | Zheng |

(Continued)

FOREIGN PATENT DOCUMENTS

| | | |
|---|---|---|
| DE | 3013178 | 4/1980 |
| FR | 2635136 | 2/1990 |

(Continued)

*Primary Examiner* — Robert G Santos
*Assistant Examiner* — Brittany Wilson
(74) *Attorney, Agent, or Firm* — Raymond Sun

(57) ABSTRACT

A baby play station has a planar mat portion having a plurality of side edges, and a plurality of walls, each wall having incorporated therewith a panel, and each wall having a lower side that is hingedly coupled to one of the plurality of side edges of the mat portion. Each panel includes a foldable frame member having a folded and an unfolded orientation, the frame member defining a periphery for the panel with an interior space inside of the peiphery, and a fabric material covering the interior space defined by the frame member to form the panel when the frame member is in the unfolded orientation.

20 Claims, 10 Drawing Sheets

(56) References Cited

U.S. PATENT DOCUMENTS

| | | | | |
|---|---|---|---|---|
| 5,370,145 | A | 12/1994 | Wu | |
| 5,385,165 | A | 1/1995 | Hazinski et al. | |
| 5,396,917 | A | 3/1995 | Hazinski et al. | |
| 5,411,046 | A | 5/1995 | Wan | |
| 5,430,980 | A | 7/1995 | Ferrier | |
| 5,439,017 | A | 8/1995 | Brown | |
| 5,439,018 | A | 8/1995 | Tsai | |
| 5,553,908 | A | 9/1996 | Shink | |
| 5,560,385 | A | 10/1996 | Zheng | |
| D375,928 | S | 11/1996 | Wang | |
| 5,575,324 | A | 11/1996 | Hwang | |
| 5,579,799 | A | 12/1996 | Zheng | |
| 5,592,961 | A | 1/1997 | Chin | |
| 5,601,105 | A | 2/1997 | Blen et al. | |
| 5,618,246 | A | 4/1997 | Zheng | |
| RE35,571 | E | 7/1997 | McLeese | |
| 5,642,750 | A | 7/1997 | Brown et al. | |
| 5,645,096 | A | 7/1997 | Hazinski et al. | |
| 5,671,479 | A | 9/1997 | Dedrick | |
| 5,676,168 | A | 10/1997 | Price | |
| 5,687,786 | A | 11/1997 | Tsai | |
| 5,732,759 | A | 3/1998 | Wang | |
| 5,735,608 | A | 4/1998 | Branco | |
| 5,778,915 | A | 7/1998 | Zheng | |
| 5,800,067 | A | 9/1998 | Easter | |
| 5,816,278 | A | 10/1998 | Kim | |
| D400,949 | S | 11/1998 | Gale | |
| 5,862,548 | A * | 1/1999 | Gerhart | 5/99.1 |
| D412,354 | S | 7/1999 | Takos | |
| 5,927,793 | A | 7/1999 | McGrath, Jr. | |
| 6,006,772 | A | 12/1999 | Zheng | |
| 6,092,544 | A | 7/2000 | Zheng | |
| D429,307 | S | 8/2000 | Wu et al. | |
| 6,109,281 | A | 8/2000 | Lowenthal | |
| 6,109,282 | A | 8/2000 | Yoon | |
| 6,155,329 | A | 12/2000 | Hwang et al. | |
| 6,192,635 | B1 | 2/2001 | Zheng | |
| 6,216,716 | B1 | 4/2001 | Gobel | |
| 6,267,128 | B1 | 7/2001 | Zheng | |
| 6,267,129 | B1 | 7/2001 | Zheng | |
| 6,273,368 | B1 | 8/2001 | Zheng | |
| 6,289,910 | B1 | 9/2001 | Zheng | |
| 6,302,127 | B1 | 10/2001 | Gayton | |
| 6,305,396 | B1 | 10/2001 | Zheng | |
| 6,325,086 | B1 | 12/2001 | Shinner et al. | |
| 6,328,050 | B1 | 12/2001 | McConnell | |
| 6,357,510 | B1 | 3/2002 | Zheng | |
| 6,390,111 | B2 | 5/2002 | Zheng | |
| D461,638 | S | 8/2002 | Kellogg et al. | |
| 6,453,923 | B2 | 9/2002 | Zheng | |
| 6,460,556 | B2 | 10/2002 | Zheng | |
| RE37,924 | E | 12/2002 | Kellogg et al. | |
| 6,494,335 | B1 | 12/2002 | Kellogg et al. | |
| 6,527,136 | B1 | 3/2003 | Sabounjian | |
| 6,604,537 | B2 | 8/2003 | Zheng | |
| 6,668,847 | B2 | 12/2003 | Zheng | |
| 6,684,894 | B2 | 2/2004 | Zheng | |
| 6,694,994 | B1 | 2/2004 | Zheng | |
| 6,698,441 | B1 | 3/2004 | Zheng | |
| 6,702,119 | B2 | 3/2004 | Sabounjian | |
| 6,705,338 | B2 | 3/2004 | Zheng | |
| 6,758,003 | B2 | 7/2004 | Zheng | |
| 6,766,815 | B2 | 7/2004 | Zheng | |
| 6,782,905 | B2 | 8/2004 | Chu et al. | |
| 6,848,460 | B2 | 2/2005 | Zheng | |
| 6,851,136 | B2 * | 2/2005 | Brereton | 5/99.1 |
| 6,926,020 | B2 | 8/2005 | Zheng | |
| 6,928,951 | B2 | 8/2005 | Huang | |
| 7,031,147 | B2 | 4/2006 | Zheng | |
| 7,080,653 | B2 | 7/2006 | Zheng | |
| 7,225,822 | B1 | 6/2007 | Zheng | |
| D551,452 | S | 9/2007 | Kellogg et al. | |
| 7,267,625 | B2 | 9/2007 | Zheng | |
| 7,284,289 | B1 * | 10/2007 | Biagini | 5/99.1 |
| 2004/0237877 | A1 | 12/2004 | Huang | |
| 2006/0117478 | A1 * | 6/2006 | Cheung | 5/99.1 |

FOREIGN PATENT DOCUMENTS

| | | |
|---|---|---|
| GB | 2340516 | 3/2000 |
| JP | 6-42227 | 2/1994 |
| JP | 8-57164 | 3/1996 |
| WO | WO 97/14863 | 4/1997 |

* cited by examiner

COLLAPSIBLE BABY PLAY STATION

BACKGROUND OF THE INVENTION

1. Field of the Invention

The present invention relates to collapsible structures, and in particular, to a play station that can be used by babies, the play station capable of being folded and collapsed to a smaller size for storage.

2. Description of the Prior Art

There are presently many collapsible structures that are being provided for use by children and adults in a number of different applications. Examples of these collapsible structures are illustrated in the following patents: U.S. Pat. Nos. 5,816,954 (Zheng), 6,006,772 (Zheng), 5,778,915 (Zheng), 5,467,794 (Zheng), 5,975,101 (Zheng), 5,722,446 (Zheng), 4,858,634 (McLeese), 4,825,592 (Norman), 5,964,533 (Ziglar), 5,971,188 (Kellogg et al.), 6,485,344 (Arias), 6,343,391 (LeGette), U.S. Pub. No. 2004/0139997 (Zheng) and 5,038,812 (Norman), among others. These collapsible structures are supported by one or more frame members that can be twisted and folded to reduce the overall size of the structure. These collapsible structures can be used in a wide variety of applications, such as containers, tents, play structures, executive toys, shelters, sports structures, and others. As a result, collapsible structures have become very popular.

Baby play stations have been provided where a baby can lie on a mat and play with toys suspended from bars that extend over the baby's body. These play stations cannot be folded or reduced in size, so they are often bulky and take up a lot of storage space when not in use.

SUMMARY OF THE DISCLOSURE

It is an object of the present invention to provide a baby play station that can be folded and reduced in size for storage.

In order to accomplish the objects of the present invention, the play station according to the present invention has a planar mat portion having a plurality of side edges, a plurality of walls, each wall having incorporated therewith a panel, and each wall having a lower side that is hingedly coupled to one of the plurality of side edges of the mat portion. Each panel includes a foldable frame member having a folded and an unfolded orientation, the frame member defining a periphery for the panel with an interior space inside of the peiphery, and a fabric material covering the interior space defined by the frame member to form the panel when the frame member is in the unfolded orientation.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
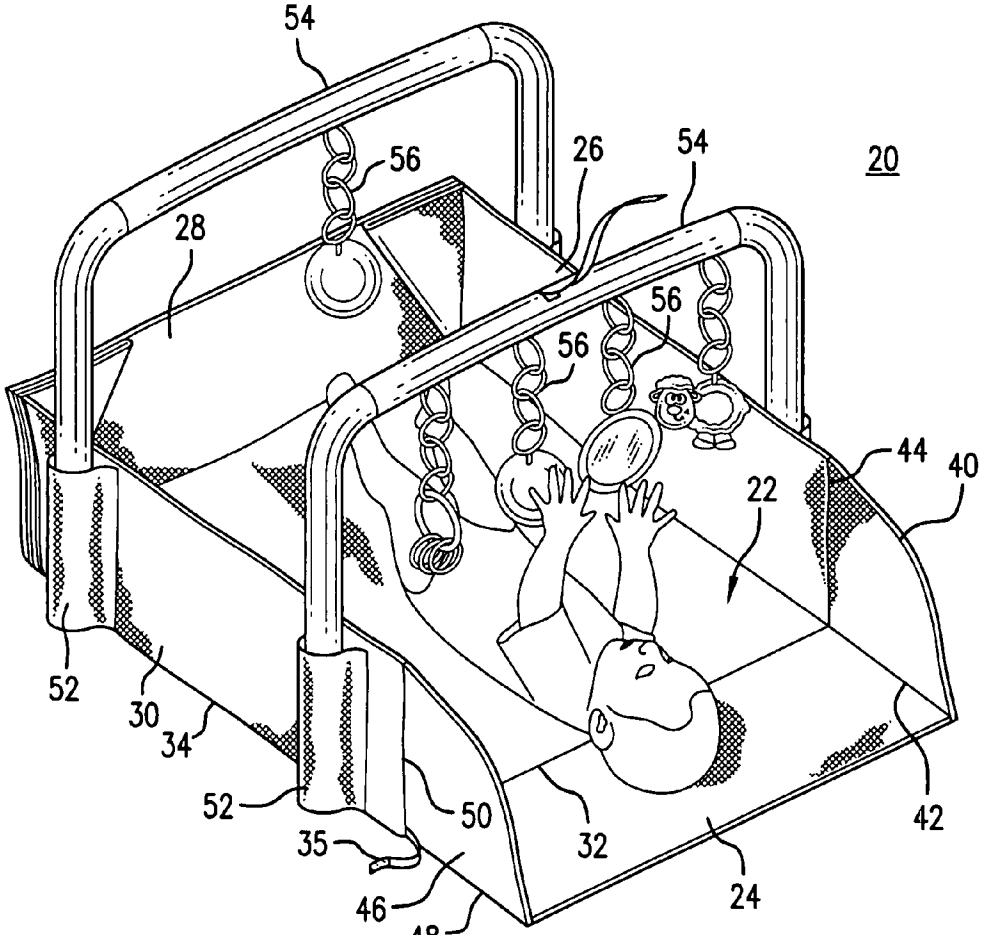
FIG. 1 is a perspective view of a baby play station according to one embodiment of the present invention.

FIG. 1 illustrates a baby play station 20 according to one embodiment of the present invention. The play station 20 has a mat portion 22 upon which a baby can lie, and four walls 24, 26, 28 and 30 that enclose the mat portion 22. The mat portion 22 is made from a soft fabric material to provide comfort and safety to a baby who is lying on the mat portion 22. As described in greater detail below, each wall 24, 26, 28, 30 is constructed of two layers of a soft fabric that defines a space inside therebetween, with a collapsible structure inserted inside the space between the two layers of fabric. The dimensions of the walls 24, 26, 28, 30 can be varied to create a rectangular or square play station 20, depending on the configuration of the mat portion 22. For example, as shown in FIG. 1, the two end walls 24 and 28 can be shorter in length than the two side walls 26 and 30 if the mat portion 22 is generally rectangular, and all four walls 24, 26, 28, 30 can be identical in size if the mat portion 22 is generally square. Each wall 24, 26, 28, 30 can have the same height, or their heights can be varied.

The mat portion 22 has four side edges (e.g., 32), and each of the four walls 24, 26, 28, 30 has a bottom side (e.g., 34) that is stitched or otherwise hingedly connected to one of the four side edges of the mat portion 22. For example, the end wall 24 can be folded up or down from the plane defined by the mat portion 22 at its hinged connection between its bottom side and the side edge 32 of the mat portion 22. The other walls 26, 28 and 30 can all be hingedly connected to corresponding side edges of the mat portion 22 so that all four walls 24, 26, 28, 30 can be pivoted up or down about their hinged connections.

Corner tuck pieces 40 are provided to connect the vertical sides of the walls 24, 26, 28, 30 to adjacent walls 24, 26, 28, 30. These tuck pieces 40 are preferably made of the same material as the fabric for the walls 24, 26, 28, 30. For example, the tuck piece 40 connects the vertical sides 42 and 44 of the adjacent walls 24 and 26, respectively. Similarly, tuck piece 46 connects the vertical sides 48 and 50 of the adjacent walls 24 and 30, respectively. Similar tuck pieces can be provided to connect the vertical sides of the end wall 28 to the other vertical sides of the side walls 26 and 30. These tuck pieces 40 can be tucked in against the walls 24, 26, 28, when the walls 24, 26, 28, 30 are folded against the mat portion 22 during storage. Removable connection mechanisms 35 (e.g., clips, hooks, VELCRO™ pads, and the like) are provided along the walls 24, 26, 28, 30 to secure the four walls 24, 26, 28, 30 in an upright orientation when the play station 20 is deployed in use.

Each side wall 26, 30 is provided with one or more tubular pockets 52 for receiving the opposing ends of a generally inverted U-shaped support bar 54. Each bar 54 is adapted to support (e.g., by suspending using conventional and known mechanisms) a plurality of baby toys 56, such as rattles, mirrors, stuffed animals, etc.

Figure 2:
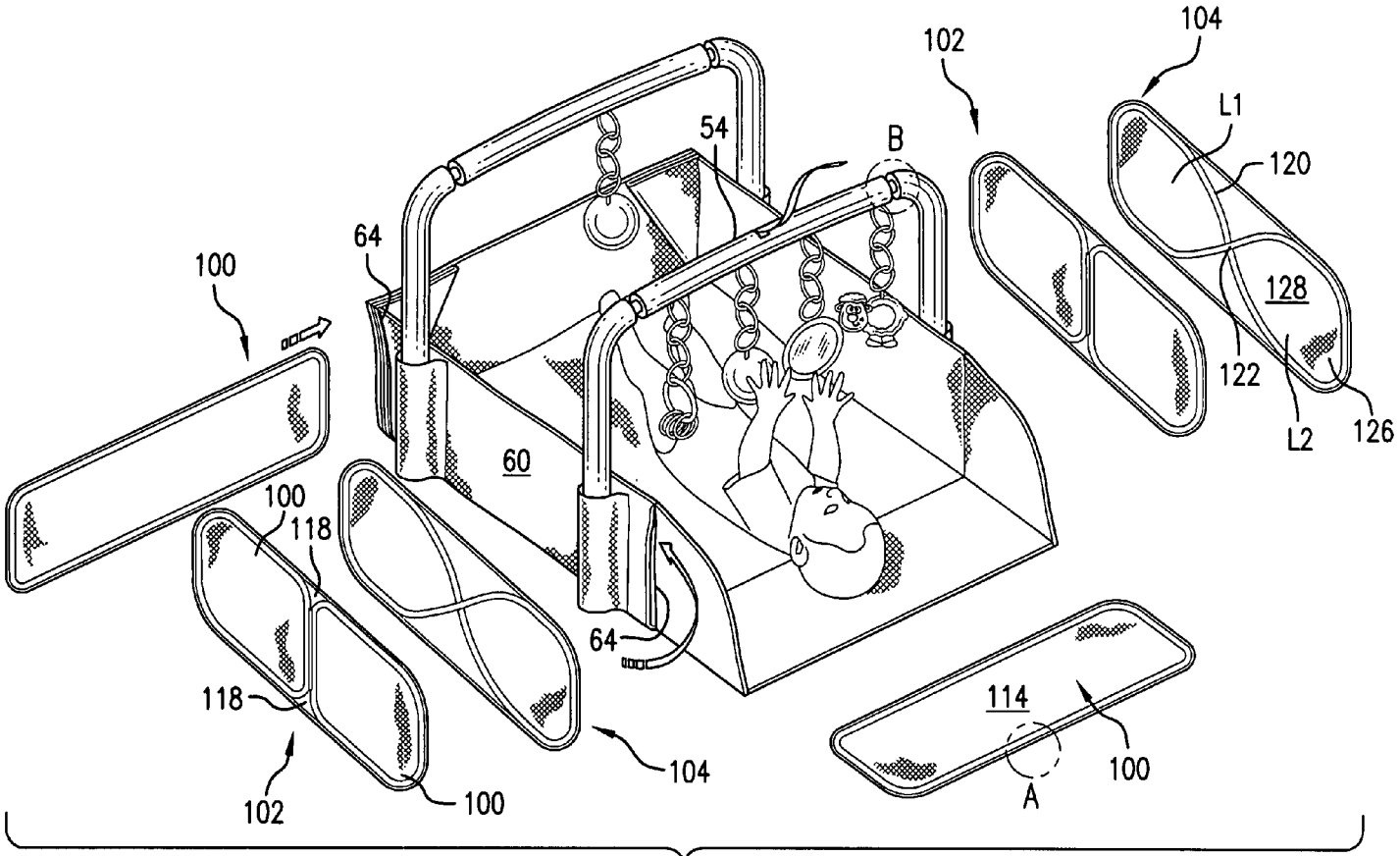
FIG. 2 is an exploded perspective view of the play station of FIG. 1.

FIG. 2 illustrates the play station 20 shown with the collapsible structures removed from the space between the two layers of fabric in the walls 24, 26, 28, 30. The collapsible structure can be embodied in the form of any of the panels 100, 102 or 104 shown in FIG. 2. Each wall 24, 26, 28, 30 is constructed of two layers 60, 62 of a soft fabric that defines a space inside therebetween, with a slit or opening 64 along one vertical side of the wall 24, 26, 28, 30, so that the panel 100, 102, or 104 can be inserted through the opening 64 to be positioned inside the space between the two layers 60, 62 of fabric, to removed from the space via the opening 64. The panels 100, 102, 104 function to provide solidity to the walls 24, 26, 28, 30.

Figure 3:
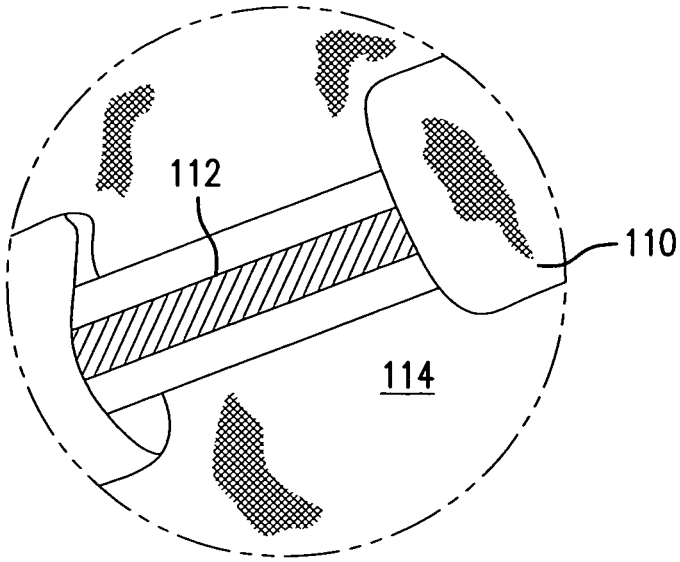
FIG. 3 is a partial cut-away view of the section A from FIG. 2 illustrating a frame member retained within a sleeve.

The panel 100 can have four sides, although the panel 100 can assume any configuration and have any number of sides (e.g., square, rectangular, oval). Referring to FIGS. 2 and 3, the panel 100 has a frame retaining sleeve 110 provided along and traversing the four edges of its four sides. A frame member 112 is retained or held within each respective frame retaining sleeve 110 to support the panel 100.

The frame member 112 may be provided as one continuous loop, or may comprise a strip of material connected at both ends to form a continuous loop. The frame member 112 is preferably formed of flexible coilable steel, although other materials such as plastics may also be used. The frame member 112 should be made of a material which is relatively strong and yet is flexible to a sufficient degree to allow it to be coiled. Thus, each frame member 112 is capable of assuming two positions or orientations, an open or expanded position such as shown in FIG. 2, or a folded position in which the frame member 112 is collapsed into a size which is much smaller than its open position (see FIG. 4C). The frame member 112 may be merely retained within the frame retaining sleeve 110 without being connected thereto. Alternatively, the frame retaining sleeve 110 may be mechanically fastened, stitched, fused, or glued to the frame member 112 to retain it in position.

A fabric material 114 extends across the panel 100, and is held taut by the frame member 112 when in its open position. The fabric material 114 is made from strong, lightweight materials and may include woven fabrics or nylons or a meshed material. The fabric material 114 should be water-resistant and durable to withstand the wear and tear associated with rough treatment.

Figure 4A:
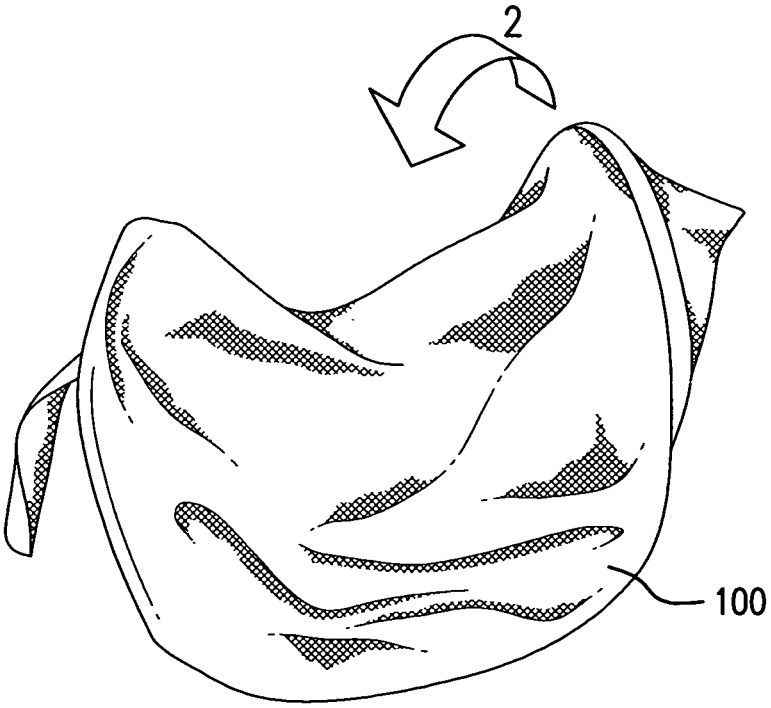
FIGS. 4A through 4C illustrate how a panel may be twisted and folded for compact storage.
Figure 4B:
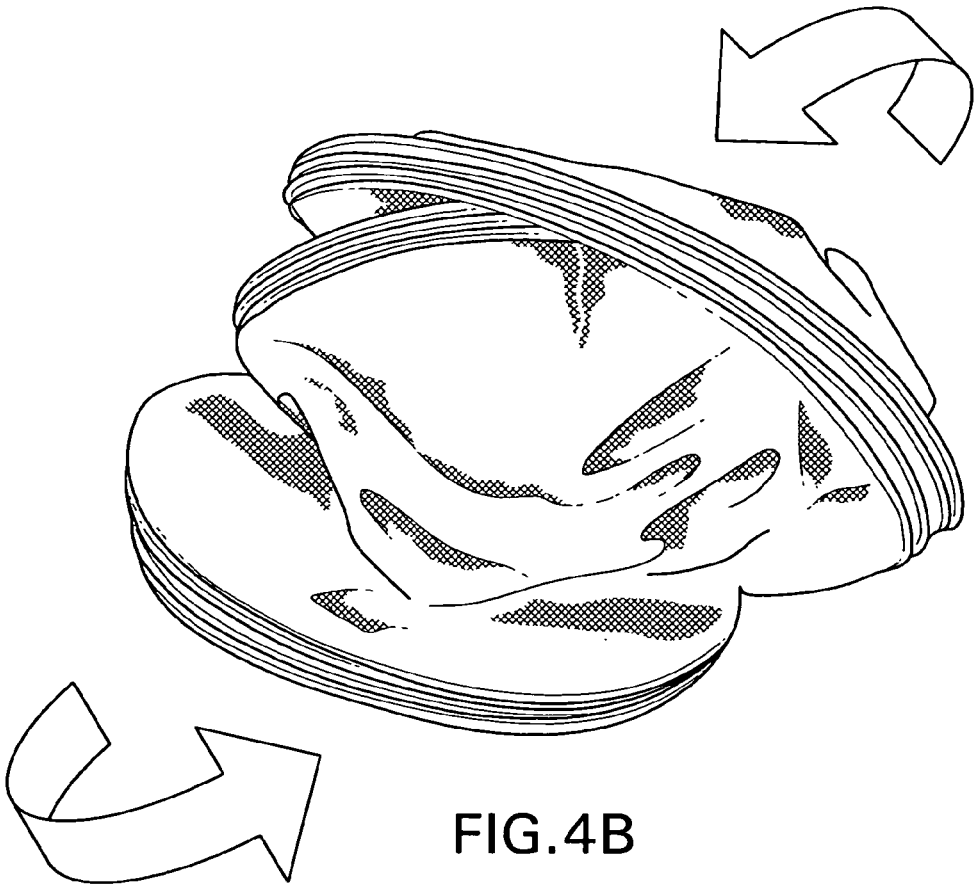
Figure 4C:
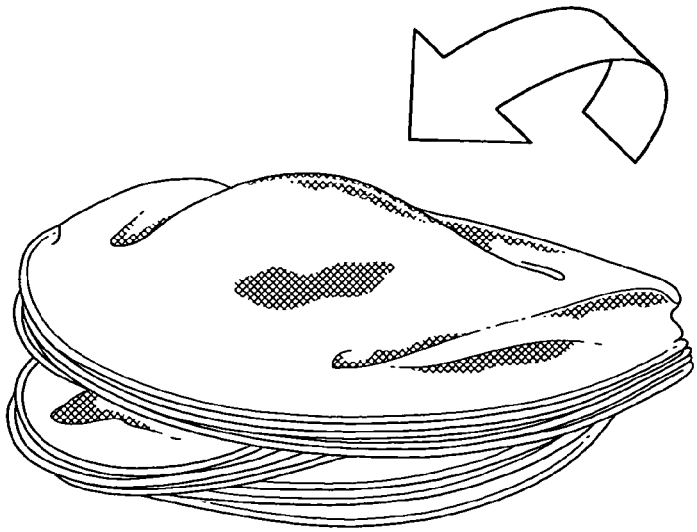

FIGS. 4A through 4C describe the various steps for folding and collapsing the panel 100 for compact storage. The first step consists of twisting and folding to collapse the frame member 112 and panel 100 into a smaller shape. In particular, the opposite border of the panel 100 is folded in (see arrow 2 in FIG. 4A) upon the previous fold to further collapse the frame member 112 with the panel 100. As shown in FIG. 4B, the folding is continued so that the initial size of the panel 100 is reduced until the frame member 112 and panel 100 are collapsed on each other (see FIG. 4C) to provide for a small essentially compact configuration having a plurality of concentric frame members 112 and layers of the panel 100 so that the collapsed panel 100 has a size which is a fraction of the size of the initial structure.

Referring back to FIG. 2, the panel 102 can be constructed with two panels 100 that are connected together by one or more fabric connectors 118. The fabric connectors 118 can be made of the same material as the fabric material 114. The panel 102 can be folded and collapsed by folding one panel 100 on top of the other panel 100, with the fabric connector(s) 118 acting as a hinged connector, to create a stack of the two panels 100 that can be twisted and folded according to the steps shown in FIGS. 4A-4C.

The panel 104 can be constructed by one resilient frame member 120 that has been twisted into a Figure-8 configuration. Referring to FIG. 2, the frame member 120 comprises a closed resilient loop. To form the Figure-8 configuration, one end of the closed frame member 120 is grasped and twisted by 360 degrees with respect to the other end. The overlapping or cross-over portions of the frame member 120 may then be secured together at 122, such as by riveting, stapling, sewing, or other conventional securing mechanisms, to hold the frame member 120 in the Figure-8 configuration. Alternatively, the overlapping portions of the frame member 120 may be left free and unsecured if the frame member 120 is retained in a frame retaining sleeve. When the frame member 120 is held in this configuration, two closed loops (see L1 and L2 in FIG. 2) are defined, with the overlapping portion or point 122 acting as a hinge for the two closed loops. Each closed loop is substantially equal in size and symmetrically disposed. Depending on the size and shape of the frame member 120, the closed loops may assume any variety of shapes, including circular or oval. Further, as shown in FIG. 2, when the frame member 120 is formed into this Figure-8 configuration, the two closed loops are biased to fold towards each other. A fabric material 128 extends across the plane of the panel 104 defined by the frame member 120.

The frame member 120 can be made from the same material as the frame member 112 described above, and can include flat spring steel stock, and in particular, stainless steel, although plastic may also be used. Referring to FIG. 2, the frame member 120 is retained in a frame retaining sleeve 126 that extends around and through panel 104 in a manner such that the frame member 120 is preferably held in tension. The frame retaining sleeve 126 may be formed by folding a peripheral edge of the fabric material 128 over the frame member 120 and then stitching, or by providing a separately-formed tubular sleeve that is stitched to the fabric material 128. Alternatively, the frame member 120 may be mechanically fastened, glued or fused to the frame retaining sleeve 126.

The panel 104 can be folded and collapsed by folding one loop L1 on top of the other loop L2, with the overlapping point 122 acting as a hinge, to create a stack of the two loops L1, L2 that can be twisted and folded according to the steps shown in FIGS. 4A-4C.

The panels 102 and 104 can be used for longer walls, such as the side walls 26 and 30, while the panel 100 can be used for any of the walls, but probably more suited for use with shorter walls, such as the end walls 24 and 28.

Figure 5:
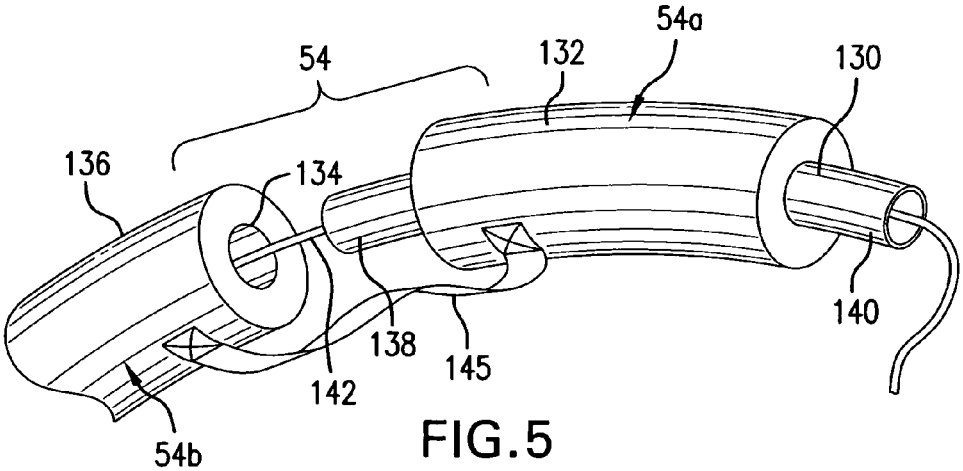
FIG. 5 is a partial cut-away view of the section B from of FIG. 2 illustrating the support bar.
Figure 9:
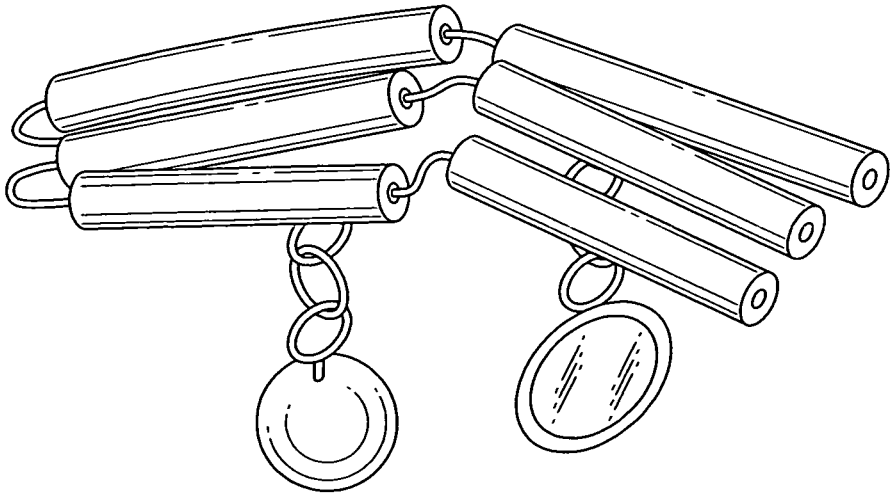
FIG. 9 illustrates a stack of folded bar sections for the support bar.

Referring to FIG. 5, the overall inverted U-shaped support bar 54 can be broken down into a plurality of bar sections 54*a*, 54*b*, etc. Each alternating bar section (e.g., 54*a*) has a tubular skeleton 130 and a cylindrical soft padding 132 wrapped around the skeleton 130. The other alternating bar section (e.g., 54*b*) has a bore 134 extending through its own skeleton 130 that is positioned inside its cylindrical soft padding 136. The opposite ends 138, 140 of the skeleton 130 extend beyond the ends of the padding 132 so that each end 138, 140 can be inserted into an open end of a bore 134 of the adjacent bar section 54*b* to connect the bar sections 54*a*, 54*b* together. The ends 138, 140 have a smaller diameter than the diameter of the bores 134 to allow the ends 138, 140 to be inserted into the bores 134. A tether 142 extends through the hollow bore of the skeletons 130 and the bores 134 of all the bar sections 54*a*, 54*b*, etc. to couple or link all the bar sections 54*a*, 54*b*, etc. together along a tether line. The tether 142 is preferably made from an elastic material to allow the tether 142 to be stretched and extended (e.g., as shown in FIG. 9 below).

As a result, the bar 54 can be deployed in two configurations, a first configuration where all the bar sections 54*a*, 54*b*, etc. are joined together to form the unitary bar 54 as shown in FIG. 2 for use in supporting play objects, and a second configuration where each bar section 54*a*, 54*b*, etc. can be disengaged from each other. In this second configuration, the user can fold each bar section 54*a*, 54*b* one on top of the other so that the unitary bar 54 shown in FIG. 2 is now collapsed into a short stack of bar sections 54*a*, 54*b*, etc. that are compact enough for convenient storage, such as shown in FIG. 9. Removable connection mechanisms 145 (e.g., VELCRO™ straps, ties, straps, etc.) can be provided on each bar section 54*a*, 54*b*, etc. to secure the bar sections 54*a*, 54*b*, etc. together when deployed for use, such as shown in FIGS. 1 and 2.

Figure 6:
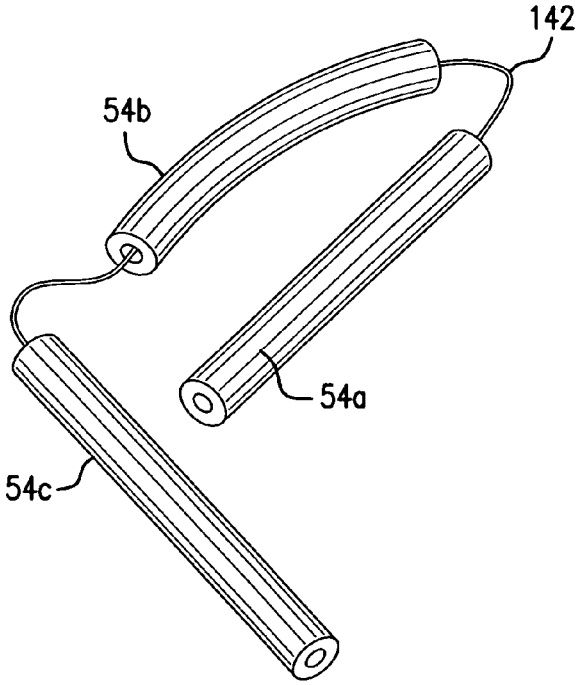
FIG. 6 illustrates one embodiment of the support bar shown in FIG. 2.

FIG. 6 shows one non-limiting embodiment of the bar 54, with the bar 54 divided into three bar sections 54*a*, 54*b*, 54*c*, with bar sections 54*a*, 54*c* being the same as bar section 54*a* shown in FIG. 5, and bar section 54*b* being the same as bar section 54*b* shown in FIG. 5.

Figure 7:
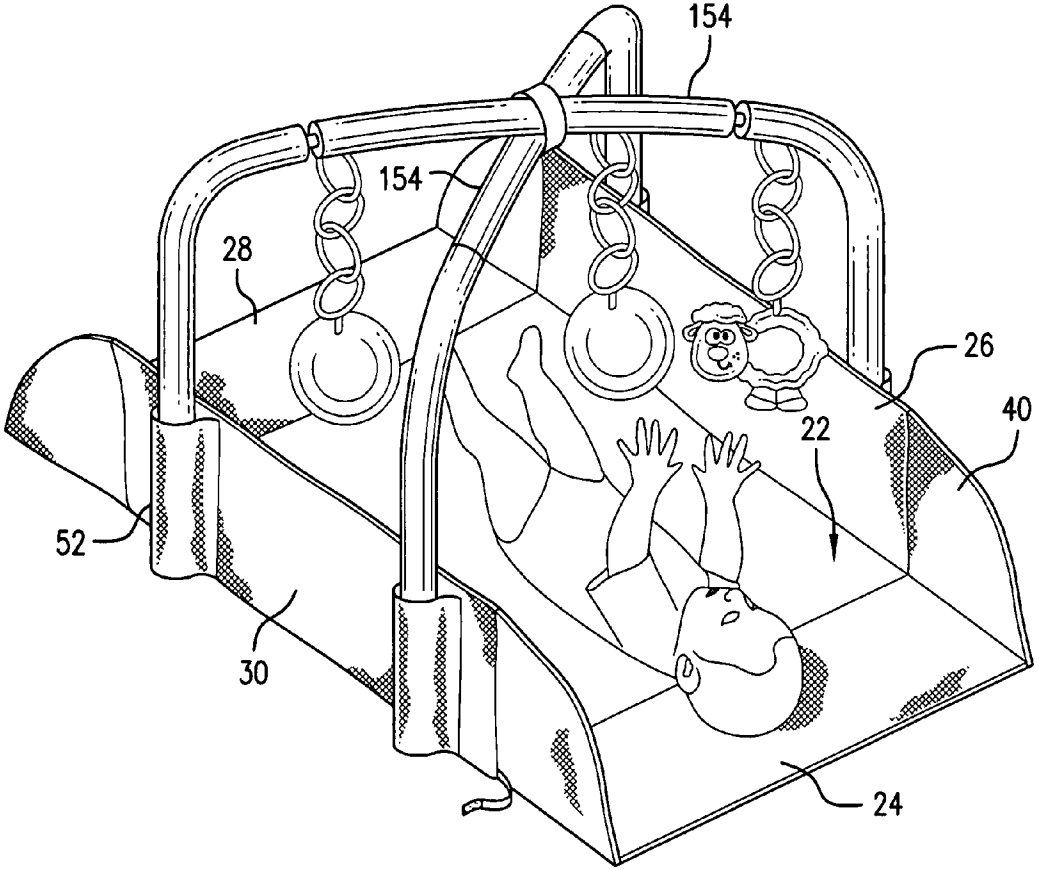
FIG. 7 illustrates a modification that can be made to the play station of FIG. 1.

FIG. 7 illustrates a modification that can be made to the play station of FIGS. 1 and 2, where the two separate inverted U-shaped support bars 54 are replaced by a single set of crossing support bars 154. The ends of the support bars 154 can still be inserted into the pockets 52 for support.

Figure 8A:
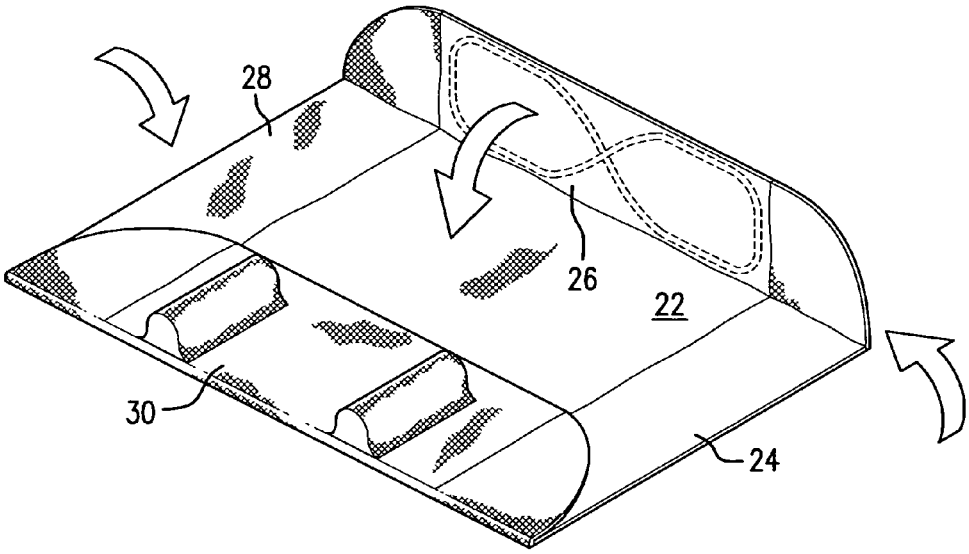
FIGS. 8A-8D illustrate the steps for dis-assembling the play station of FIG. 1.
Figure 8B:
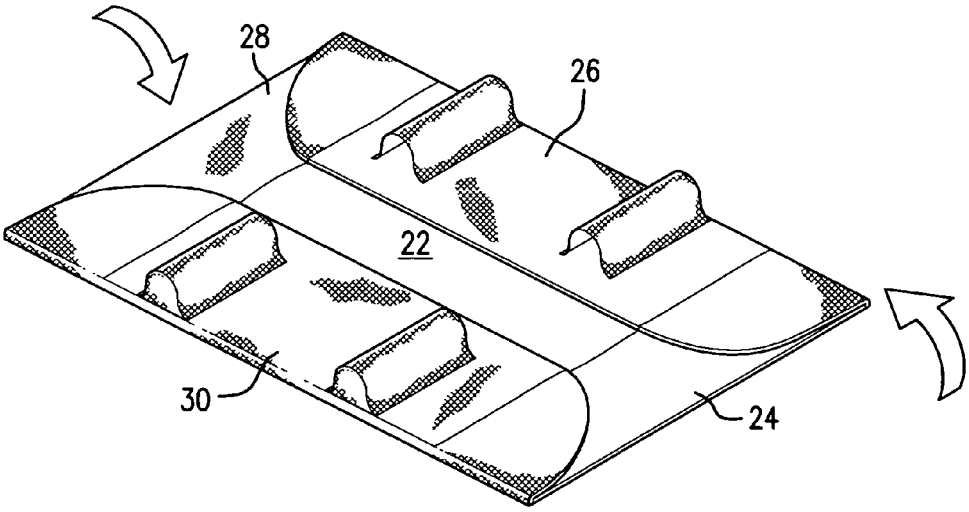

Thus, the play station 20 according to the present invention provides significant benefit over the conventional play stations in that the play station 20 can be conveniently disassembled, packed up, and stored. In particular, from the normal use configuration shown in FIG. 1, the user can easily dis-assemble the play station 20 in the following manner: First, the various panels 100, 102 and/or 104 can be removed from the walls 24, 26, 28, 30, and each of these panels 100, 102, 104 can be twisted and folded according to the steps in FIGS. 4A-4C to reduce their overall sizes. The support bars 54 or 154 can also be removed and detached into separate bar sections to form a stack of folded bar sections (see FIG. 9). Next, as shown in FIG. 8A, the longer side walls 26, 30 are folded inwardly onto the mat portion 22 (see FIG. 8B), and then the end walls 24, 28 are folded inwardly to be on top of the side walls 26, 30 and the mat portion 22 (see FIG. 8C). In the next step, the combined walls 24, 26, 28, 30 and mat portion 22 can be folded in half at about the center of the mat portion (see FIG. 8D). Finally, the separate components (folded walls 24, 26, 28, 30 and mat portion 22 from FIG. 8D, the collapsed panels 100, 102, 104, and the stack of folded bar sections from FIG. 9) can be stored together in a bag or pouch (not shown) that is much smaller in size and shape than would otherwise be needed to stored the assembled play station 20.

Figure 8C:
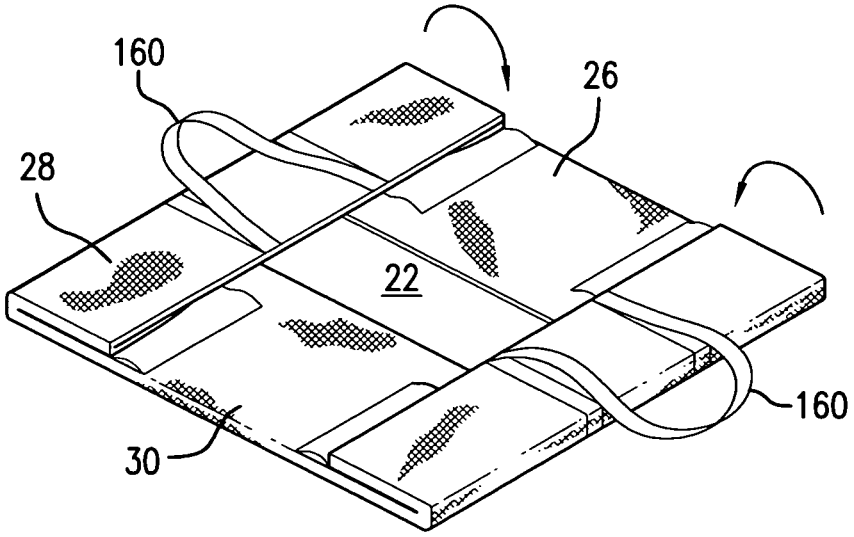
Figure 8D:
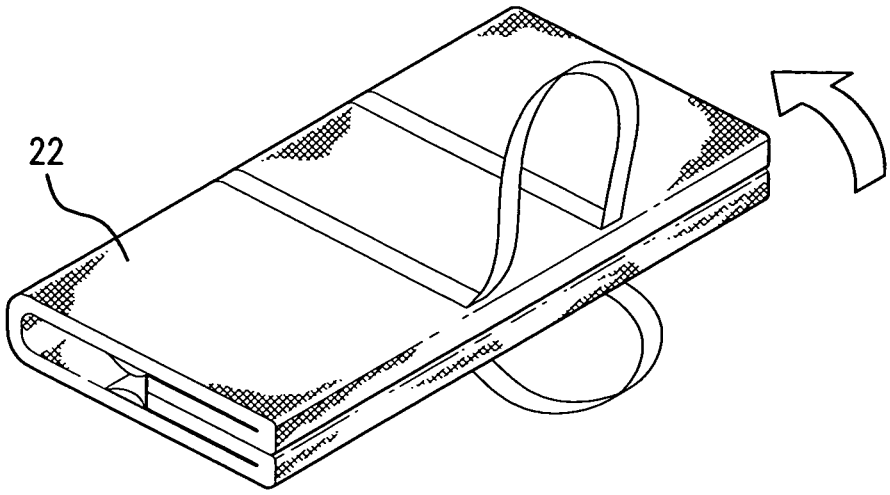

As shown in FIGS. 8C and 8D, handles 160 can be provided on the rear surfaces of the mat portion 22. In such an embodiment, the collapsed panels 100, 102, 104, and the stack of folded bar sections from FIG. 9, can be stored between the folded halves of the mat portion 22 so that the folded mat portion 22 can also act as a housing or carrying case for the play station 20.

Figure 10:
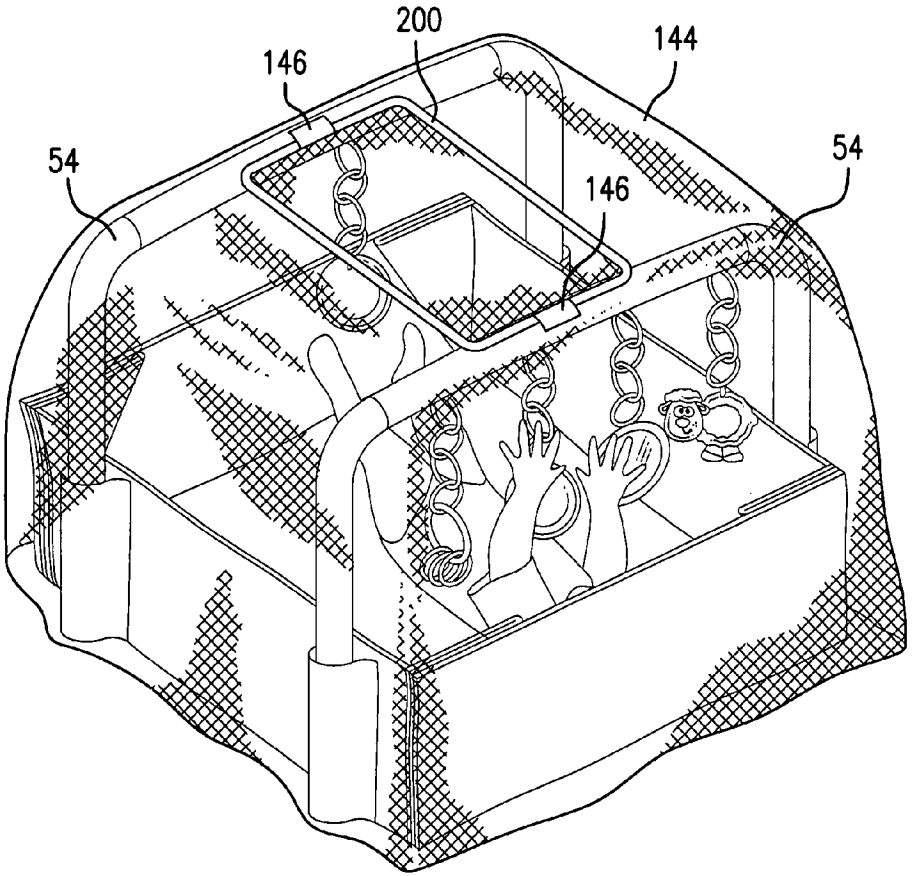
FIG. 10 illustrates additional modifications that can be made to the play station of FIG. 1.

FIG. 10 illustrates two optional features that can be provided for the play station 20 of FIG. 1. First, a meshed or other cover 144 can be draped over the top of the support bars 54 to shield the baby from flies and other insects. A panel 200, which can be identical in construction to the panel 100, can be stitched or otherwise secured to the cover 144, and provided with attachment mechanisms 146 (e.g., hooks, VELCRO™ pads) that allow the panel 200 to be removably secured to the top of the support bars 54. This allows the cover 144 to be secured to the support bars 54 in a manner which prevents the cover 144 from falling onto the baby.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A baby play station, comprising:

a planar mat portion having a plurality of side edges;

a plurality of planar walls, each wall having two layers of a soft fabric that define a space therebetween, and each wall having a lower side that is hingedly coupled to one of the plurality of side edges of the mat portion;

a plurality of removable planar panels, each panel comprising a foldable frame member having a folded and an unfolded orientation, the frame member defining a periphery for the panel with an interior space inside of the periphery, and a fabric material extending in a planar manner to cover the interior space defined by the frame member to form the panel when the frame member is in the unfolded orientation; and wherein each panel is retained in the space of a corresponding wall when the panel is in the unfolded orientation, and when the panel is removed from the space, the panel is folded to the folded orientation.

2. The play station of claim 1, wherein each panel further includes a frame retaining sleeve for retaining each frame member.

3. The play station of claim 1, wherein each frame member is twisted and folded to its folded orientation to reduce the overall size of the frame member.

4. The play station of claim 1, wherein each frame member is continuous and enclosed.

5. The play station of claim 1, further including:

a support bar having opposing first and second ends that are removably coupled to opposing walls, and with the support bar extending above the mat portion and across the opposing walls; and a plurality of toys suspended from the support bar.

6. The play station of claim 5, wherein the support bar comprises at least a first bar section alternating with a second bar section;

wherein the first bar section has a tubular skeleton having a bore, and a cylindrical soft padding wrapped around the skeleton, the skeleton having opposite ends that extend beyond the ends of the padding;

wherein the second bar section has a cylindrical soft padding with a bore extending therethrough, with the opposite ends of the skeleton inserted into the bore of the second bar section to connect the first and second bar sections together; and an elastic tether that extends through the bores of the first and second bar sections to couple the first and second bar sections.

7. The play station of claim 1, wherein the plurality of panels includes a first panel that has a single frame member, and a second panel that has a frame member shaped as a figure-8.

8. The play station of claim 1, wherein the plurality of panels includes a first panel that has a single frame member, and a second panel that has two frame members.

9. The play station of claim 5, further including a cover that is provided over the top of the support bar, with a panel secured to the cover and removably coupled to the support bar.

10. A baby play station, comprising:

a planar mat portion having a plurality of side edges;

a plurality of planar walls, each wall having incorporated therewith a removable planar panel, and each wall having a lower side that is hingedly coupled to one of the plurality of side edges of the mat portion; and wherein each panel comprises a foldable frame member having a folded and an unfolded orientation, the frame member defining a periphery for the panel with an interior space inside of the periphery, and a fabric material extending in a planar manner to cover the interior space defined by the frame member to form the panel when the frame member is in the unfolded orientation.

wherein each panel is incorporated with a corresponding wall when the panel is in the unfolded orientation, and when the panel is removed from the wall, the panel is folded to the folded orientation.

11. The play station of claim 10, wherein each panel further includes a frame retaining sleeve for retaining each frame member.

12. The play station of claim 10, wherein each frame member is twisted and folded to its folded orientation to reduce the overall size of the frame member.

13. The play station of claim 10, wherein each frame member is continuous and enclosed.

14. The play station of claim 10, further including:

a support bar having opposing first and second ends that are removably coupled to opposing walls, and with the support bar extending above the mat portion and across the opposing walls; and a plurality of toys suspended from the support bar.

15. The play station of claim 14, wherein the support bar comprises at least a first bar section alternating with a second bar section;

wherein the first bar section has a tubular skeleton having a bore, and a cylindrical soft padding wrapped around the skeleton, the skeleton having opposite ends that extend beyond the ends of the padding;

wherein the second bar section has a cylindrical soft padding with a bore extending therethrough, with the opposite ends of the skeleton inserted into the bore of the second bar section to connect the first and second bar sections together; and an elastic tether that extends through the bores of the first and second bar sections to couple the first and second bar sections.

16. The play station of claim 10, wherein the plurality of panels includes a first panel that has a single frame member, and a second panel that has a frame member shaped as a figure-8.

17. The play station of claim 10, wherein the plurality of panels includes a first panel that has a single frame member, and a second panel that has two frame members.

18. The play station of claim 14, further including a cover that is provided over the top of the support bar, with a panel secured to the cover and removably coupled to the support bar.

19. A baby play station, comprising:

a planar mat portion having a plurality of side edges;

a plurality of planar walls, each wall having incorporated therewith a removable planar panel, and each wall having a lower side that is hingedly coupled to one of the plurality of side edges of the mat portion;

wherein each panel comprises a foldable frame member having a folded and an unfolded orientation, the frame member defining a periphery for the panel with an interior space inside of the periphery, a fabric material extending in a planar manner to cover the interior space defined by the frame member to form the panel when the frame member is in the unfolded orientation, and wherein each frame member is twisted and folded to its folded orientation to reduce the overall size of the frame member;

wherein each panel is incorporated with a corresponding wall when the panel is in the unfolded orientation, and when the panel is removed from the wall, the panel is folded to the folded orientation;

a support bar having opposing first and second ends that are removably coupled to opposing walls, and with the support bar extending above the mat portion and across the opposing walls; and a plurality of toys suspended from the support bar.

20. The play station of claim 19, wherein the support bar comprises at least a first bar section alternating with a second bar section;

wherein the first bar section has a tubular skeleton having a bore, and a cylindrical soft padding wrapped around the skeleton, the skeleton having opposite ends that extend beyond the ends of the padding;

wherein the second bar section has a cylindrical soft padding with a bore extending therethrough, with the opposite ends of the skeleton inserted into the bore of the second bar section to connect the first and second bar sections together; and an elastic tether that extends through the bores of the first and second bar sections to couple the first and second bar sections.

* * * * *